US009574145B1

(12) United States Patent
McKnight et al.

(10) Patent No.: US 9,574,145 B1
(45) Date of Patent: Feb. 21, 2017

(54) UPGRADING OF BITUMEN

(71) Applicant: SYNCRUDE CANADA LTD., Fort McMurray (CA)

(72) Inventors: Craig A. McKnight, Sherwood Park (CA); Jason Wiens, Edmonton (CA)

(73) Assignee: SYNCRUDE CANADA LTD., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 14/885,745

(22) Filed: Oct. 16, 2015

(51) Int. Cl.
*C10G 69/06* (2006.01)
*C10G 47/30* (2006.01)
*C10G 69/04* (2006.01)

(52) U.S. Cl.
CPC ..... *C10G 69/06* (2013.01); *C10G 47/30* (2013.01); *C10G 69/04* (2013.01)

(58) Field of Classification Search
CPC ..... C10G 11/18; C10G 1/002; C10G 1/00; C10G 9/005; C10G 2300/107; C10G 2300/1077; C10G 2300/301; C10G 65/12; C10G 69/04; C10G 69/06; C10G 2300/708; C10G 57/00; C10G 69/02; B01J 8/24
See application file for complete search history.

(56) References Cited

U.S. PATENT DOCUMENTS 3,245,900 A * 4/1966 Paterson ..... C10G 69/04 208/110
2015/0008157 A1* 1/2015 Smiley ..... C10G 69/06 208/53

OTHER PUBLICATIONS

Baldassari et al, LC-MAX and Other LC_fining Process ENhancements to Extend Conversion and On-stream Factor, 2012, 1-12.*

* cited by examiner

*Primary Examiner* — Randy Boyer
*Assistant Examiner* — Juan Valencia
(74) *Attorney, Agent, or Firm* — Bennett Jones LLP

(57) ABSTRACT

A method of upgrading bitumen in a plant comprising a diluent recovery unit that processes diluted bitumen and outputs atmospheric topped bitumen (ATB), a vacuum distillation unit which processes ATB and outputs vacuum topped bitumen (VTB), and at least one fluid coker unit which processes VTB and outputs a tar pot bottom stream comprising heavy heavy gas oil is provided comprising the step of processing the tar pot bottom stream in a catalytic hydrocracking unit comprising an ebullated bed reactor to produce naphtha, light gas oil, and heavy gas oil.

6 Claims, 10 Drawing Sheets

UPGRADING OF BITUMEN

FIELD OF THE INVENTION

This invention relates to an improved process of upgrading bitumen.

BACKGROUND

Upgrading is the processing of bitumen, heavy oil or hydrocarbon residues to produce a better quality crude oil product. The upgrading process can result in a synthetic crude product with reduced viscosity which may be transported by pipeline without a diluent, a product with reduced density to produce an economically more valuable product, and the removal of contaminants such as metals and sulphur.

The reactions used to upgrade bitumen fall mainly into two different categories. First, thermal cracking reactions use heat to drive the upgrading process, usually with the formation of coke. Fluid coking is a thermal conversion process where long chain bitumen molecules are cracked into more valuable short chain molecules. It is a continuous operation where fluidized coke particles are transferred back and forth between the reactor and burner vessels. A portion of the coke produced in this process is transferred to the burner to provide heat for the thermal cracking process. The second category includes catalytic reactions with hydrogen gas.

A hydroprocessing unit such as an LC-Finer™ is an example of an ebullated bed catalytic hydrocracker. The principal advantage of hydrocracking technology compared to fluid coking is the ability to convert microcarbon residue (MCR) into distillable products and hydrogen-rich pitch materials. As such, the greatest benefit of the hydrocracker is realized when the maximum possible pounds of MCR are converted; improving the yield of synthetic crude on each barrel of bitumen processed.

In one commercial operation, fluid coking and hydrocracker processing have been operated in parallel, where both the fluid coker and the hydrocracker process a mixture of atmospheric topped bitumen and vacuum topped bitumen. The unconverted hydrocracker bottoms have then been processed in the fluid coker. However, hydrocracker throughput has been limited by the pumping capacity of the hydrocracker bottoms to the coker and the reactor exotherm. The presence of hydrocracker bottoms arises from unconverted pitch in the product stream. Reactor exotherm arises from the consumption of hydrogen due to removal of heteroatoms (primarily sulfur, nitrogen, nickel, and vanadium) and hydrogenation (i.e. saturation of aromatics, olefins/free radicals resulting from boiling point reduction, etc.).

The focus on improving performance of hydrocracking technology has typically been on developing improved activity catalysts for the feed, which is typically a mixture of atmospheric topped bitumen and vacuum topped bitumen. However, there may be an opportunity to improve hydrocracker throughput and conversion by improving the feed quality.

SUMMARY OF THE INVENTION

The present invention relates to methods and systems for upgrading bitumen, and in particular, for a method of upgrading bitumen which includes the step of hydroprocessing tar pot bottoms from a coker.

The inventors have evaluated conversion performance (i.e. for pitch, MCR, sulfur, nitrogen, and vanadium) of a tar pot material from a fluid coker in a pilot scale hydrocracking apparatus (a mini ebullate bed reactor or MEBR). The tar pot material comprises a heavy heavy gas oil (HHGO) which contains the same amount of pitch as ATB/VTB mixed feed, but with lower metals and MCR content. Results of the testing indicated that, compared to standard 60% ATB/40% VTB feed, the conversion kinetics for the tar pot stream were considerably improved for all species. The kinetic rate constant of pitch conversion ($1^{st}$ order) was approximately double that of standard feed; and the kinetic rate constant of MCR conversion ($2^{nd}$ order) was approximately an order of magnitude larger. The results indicate that a hydrocracker can theoretically process 77 kBPD of tar pot material, compared to 50 kBPD of conventional feed. At these feed rates, it is believed that 45% more pounds of pitch and 31% more pounds of MCR would be converted using tar pot feed.

Therefore, in one aspect, the invention may comprise a method of upgrading bitumen in a plant comprising a diluent recovery unit which processes diluted bitumen and outputs atmospheric topped bitumen (ATB), a vacuum distillation unit which processes ATB and outputs vacuum topped bitumen (VTB), and at least one coker unit which processes VTB and outputs a tar pot bottom stream comprising heavy heavy gas oil, the method comprising the step of:

(a) processing the tar pot bottom stream in a catalytic hydrocracking unit comprising an ebullated bed reactor to produce naphtha, light gas oil, and heavy gas oil.

In one embodiment, unconverted bottoms from the catalytic hydrocracking unit can be recycled to the coker or sent to product as fluid catalytic cracking (FCC) feedstock.

BRIEF DESCRIPTION OF THE DRAWINGS

The following drawings form part of the specification and are included to further demonstrate certain embodiments or various aspects of the invention. In some instances, embodiments of the invention can be best understood by referring to the accompanying drawings in combination with the detailed description presented herein. The description and accompanying drawings may highlight a certain specific example, or a certain aspect of the invention. However, one skilled in the art will understand that portions of the example or aspect may be used in combination with other examples or aspects of the invention.

DETAILED DESCRIPTION

As used herein, certain terms have the meanings defined below. All other terms and phrases used in this specification have their ordinary meanings as one of skilled in the art would understand. Such ordinary meanings may be obtained by reference to technical dictionaries, such as *Hawley's Condensed Chemical Dictionary* 14$^{th}$ Edition, by R. J. Lewis, John Wiley & Sons, New York, N.Y., 2001. The art of bitumen upgrading is reviewed in *Upgrading Oilsands Bitumen and Heavy Oil* by Murray R. Gray, the entire contents of which is incorporated herein for all purposes, where permitted.

Figure 1:
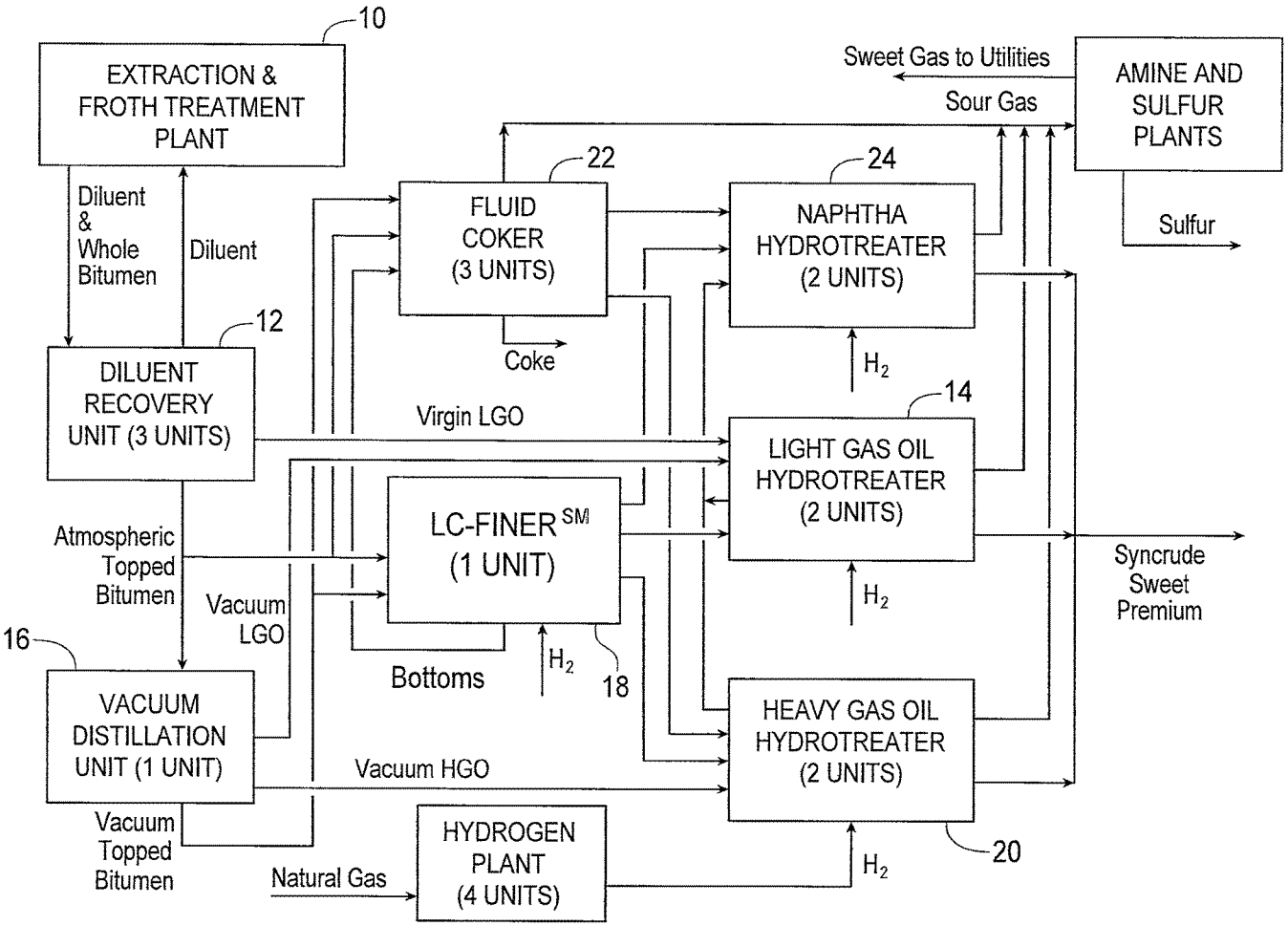
FIG. 1 (PRIOR ART)
FIG. 1 (PRIOR ART) shows a conventional upgrading flowsheet with general blocks of gas oil removal by distillation, conversion processes, hydrotreating to improve product quality, and support units.

A conventional prior art upgrading process is schematically illustrated in FIG. 1. Bitumen from the extraction plant (10) is diluted with naphtha and transported to a diluent recovery unit (12), where any naturally occurring light gas oil component of bitumen is removed, and the diluent is separated and removed for reuse. The diluent recovery unit may operate much like an atmospheric distillation unit in a conventional refinery. The light gas oil stream is sent to a light gas oil hydrotreater (14) and the bottoms—atmospheric topped bitumen—is predominantly fed to a vacuum distillation unit (VDU) (16), with a smaller proportion going directly to a hydrocracking unit (18). The VDU removes all of the remaining light and heavy gas oils, directing these streams to the light gas oil hydrotreater (14) and the heavy gas oil hydrotreater (20) respectively. The bottoms from the VDU—vacuum topped bitumen—are fed to the coking unit (22) and to the hydrocracking unit (18), which may be an LC-Finer™ unit. The coking unit (22) is a thermal conversion unit that cracks long chain bitumen molecules into more valuable short chain molecules—heavy gas oil, light gas oil and naphtha. In one example, the coking process is a fluid coking process which is a continuous operation where fluidized coke particles are transferred back and forth between the reactor and burner vessels. A portion of the coke produced in this process is transferred to the burner to provide heat for the thermal cracking process. The hydrocracking unit (18) is an ebullated bed reactor that uses catalyst and hydrogen to convert bitumen into gas oils and naphtha. Suitable catalysts are well known in the art, and may include nickel-molybdenum/alumina catalysts.

Intermediate naphtha and gas oil products are processed in a naphtha hydrotreater unit (24), the light gas oil hydrotreater (14) and the heavy gas oil hydrotreater (20). These hydrotreater units (14, 20, 24) operate at high pressure and use fixed bed catalytic reactors to treat the product to remove sulphur, nitrogen and other impurities. The output from these units is blended together to form synthetic crude oil.

There are numerous other units in upgrading that are involved in the operation, which are not explicitly described or illustrated. One skilled in the art will be aware of and be able to implement such other units. These include hydrogen units that supply hydrogen to the hydrotreaters, environmental units that treat water and gas streams, and sulphur recovery units.

Figure 2:
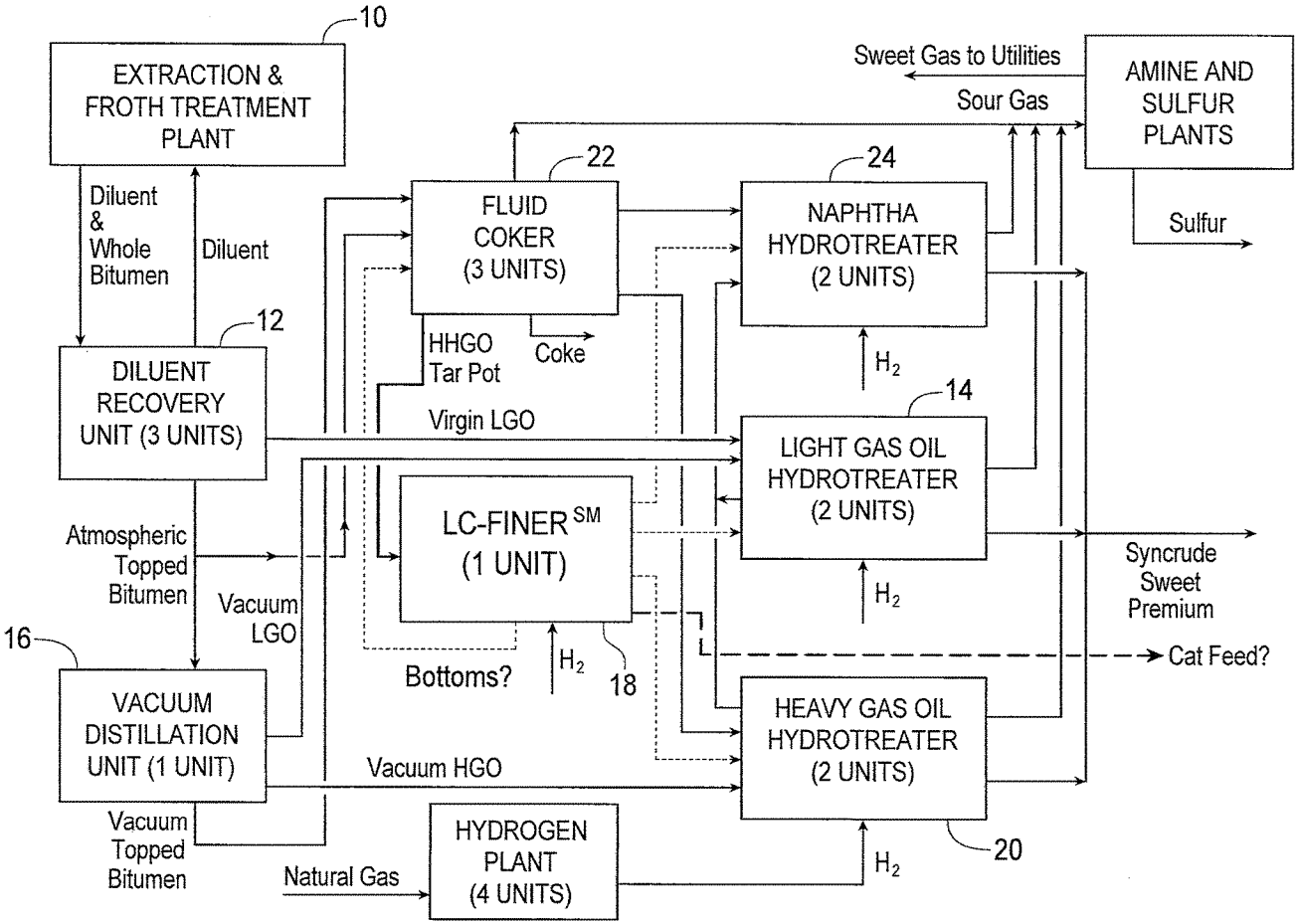
FIG. 2 shows, for one embodiment of the invention, a flowsheet modification to integrate carbon rejection (coking) and hydrogen addition (hydrocracking) to maximize liquid product yield.

In one aspect, the present invention relates to a modification of the conventional scheme described above, and is shown schematically in FIG. 2. Most aspects of the process are the same, but with at least one significant difference in the feed that is processed in the hydrocracking unit. Instead of a feed consisting of ATB and VTB, the hydrocracking unit (18) receives the tar pot bottoms from a fluid coking unit (22).

Figure 3:
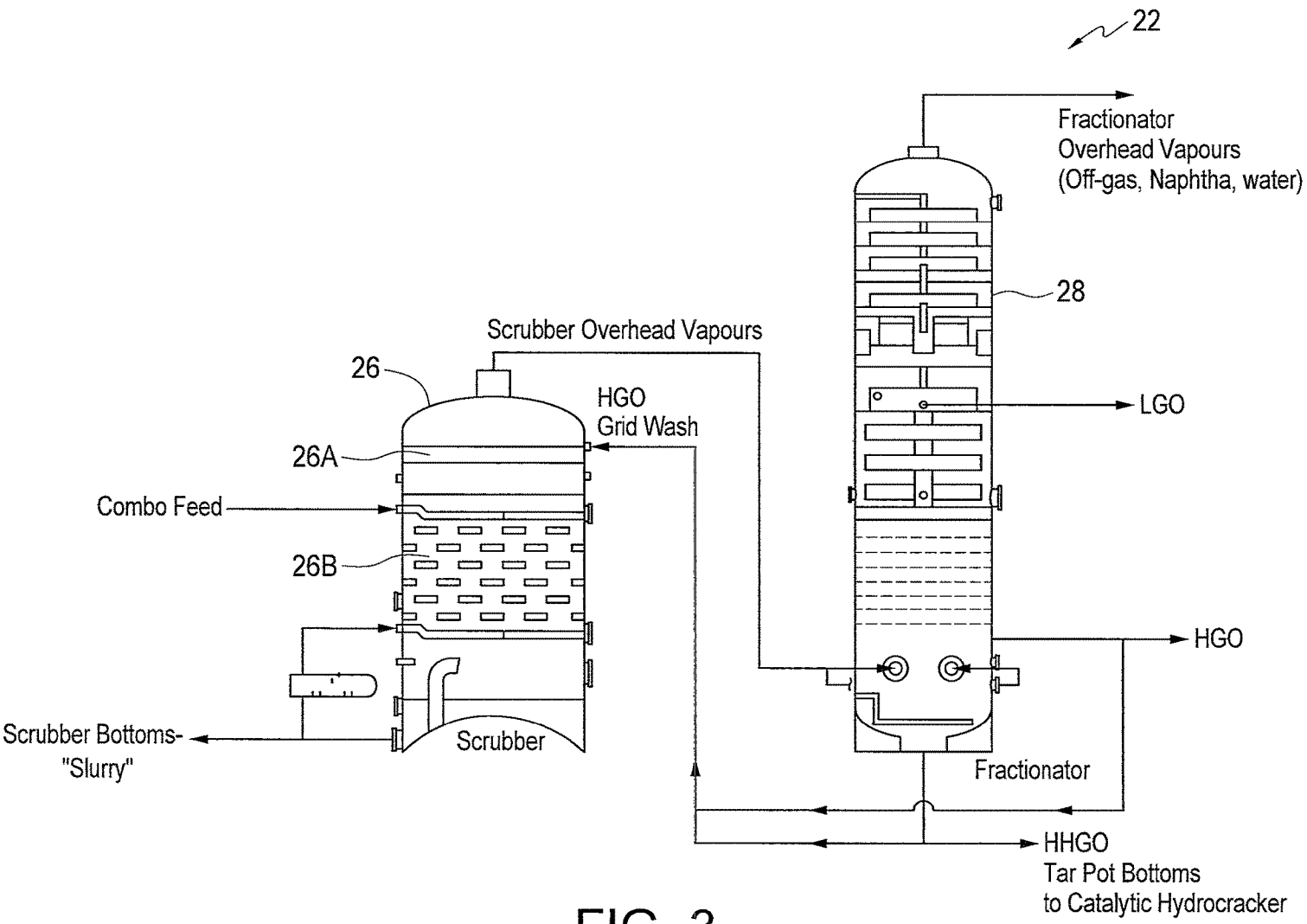
FIG. 3 shows one embodiment of a coker fractionation system.

FIG. 3 shows a conventional fluid coker comprising a scrubber (26) and a fractionator (28) where the scrubber mixes the fresh feed (composed of ATB, VTB, and optionally hydrocracker (18) bottoms) with the slurry recycle stream (SRS) from the scrubber, and this mixture is partly diverted back to the scrubber as shed wash. A grid, or grid wash (26A) are located above the scrubber sheds (26B) to knock out coke particles and entrained heavy oil droplets from the overhead vapours, which are fed to the fractionators (28). The fractionator operates to produce overhead vapours (off-gas, naphtha, steam), a light gas oil (LGO) stream, and a heavy gas oil (HGO) stream. The HGO stream emerges near the bottom of the fractionators, may be used as a spray chamber grid wash (26A) in the scrubber. The fractionator bottoms, a heavy heavy gas oil (HHGO) known as tar pot bottoms, is diverted to be treated in the catalytic hydrocracker (18). A portion of the HHGO stream may also be used as a spray chamber grid wash in the scrubber, together with the HGO wash stream. Alternatively, the fractionator may comprise a wash zone in addition to or in place of a separate scrubber, as is well known in the art.

The tar pot material is then processed in the hydrocracking unit (18) to produce naphtha, light gas oil and heavy gas oil. The tar pot material may have significantly lower nickel and vanadium than bitumen, an appreciable MCR content, and pitch content comparable to the conventional feed blend which consists of 60% ATB/40% VTB.

The bottoms from the hydrocracking unit (18) may be recycled back to the fluid coker, or may be removed and used as fluid catalytic cracking feed.

EXAMPLES

The following examples are intended to be descriptive or supportive of exemplary embodiments of the invention, but not limiting of the claimed invention.

Example 1

Materials and Methods

The kinetic parameters for pitch, MCR, sulfur, nitrogen, and vanadium conversion were evaluated in a mini ebullating bed reactor (MEBR) unit for a tar pot stream. Compared to standard feed (60% ATB/40% VTB), the conversion kinetics for the tar pot stream were considerably improved for all species. Most noteworthy, the kinetic rate constant of pitch conversion (1$^{st}$ order) was approximately double that of standard feed; and the kinetic rate constant of MCR conversion (2$^{nd}$ order) was approximately an order of magnitude larger. However, while the pitch content of the two feeds were similar, the MCR content of tar pot was approximately half that of standard feed pitch. In addition to improved kinetics, results of the testing indicate that tar pot feed reduces the rate of catalyst deactivation.

The conversion of tar pot feed run over a nickel-molybdenum/γ-alumina catalyst was tested in a test hydrocracker unit (MEBR 62). The measured conversions were compared to a previous baseline run using standard 60% ATB/40% VTB feed run over the catalyst (MEBR 59), in particular, comparisons were made on the basis of pitch and MCR conversion, and hydrodesulfurization (HDS), hydrodenitrification (HDN), and hydrodemetalization (HDM).

In the test, three different feeds were used over the duration of the run. In sequence, they were: tar pot, a mixture of tar pot and standard ATB/VTB feed, and standard ATB/VTB feed. For all feeds used, the test unit was operated at a temperature and pressure of 440° C. and 10.4 MPa, respectively, hydrogen was added at a rate of 29 scc/s, the recycle pump speed was maintained at 500 RPM, and 40 g of catalyst was used.

The tar pot feed was obtained from a fluid coker fractionator (i.e. 1 gallon samples taken from control valve swings and blended). The properties of this feed are listed in Table 1. As can be seen in the table, the tar pot material had a significantly lower concentration of MCR, nickel, and vanadium compared to standard feed (60% ATB/40% VTB) used in run MEBR 59. Tar pot feed was targeted to operate at a feed rate of 136 g/hr. A six day run on tar pot feed was performed. Following this 6 day run, a mixed tar pot/standard feed run was performed for two days (the relative quantities of standard feed and tar pot feed are not known). After this two day run, a six day run on standard feed was performed operating at a feed rate of 130 g/hr.

TABLE 1

Feed properties used in MEBR testing,

| | Standard ATB/VTB Feed | tar pot |
|---|---|---|
| Density (g/mL) | 1.034 | 1.034 |
| Sulfur (wppm) | 53253 | 46255 |
| Nitrogen (wppm) | 5522 | 5593 |
| Carbon (wt %) | 82.27 | 84.20 |
| Hydrogen (wt %) | 10.10 | 9.61 |
| EXM (wt %) (TI solids) | 0.53 | 0.06 |
| MCR (wt %) | 18.22 | 9.56 |
| D1160 Distillation | | |
| IBP – 524 | 27.45 | 29.66 |
| 524+ | 71.47 | 69.38 |
| Metals Analysis | | |
| Ni (wppm) | 111 | BDL |
| V (wppm) | 286 | 35 |

After each day of the run, a complete mass balance was performed on the reactor. The sulfur and nitrogen removal, pitch conversion, MCR removal, nickel and vanadium removal were the variables of interest in this pilot plant testing. Kinetic rate constants were calculated from the conversion data for all tests. The experimentally measured conversions and kinetic rate constants were adjusted to 440° C. using the respective rate equations and activation energies.

Figure 4:
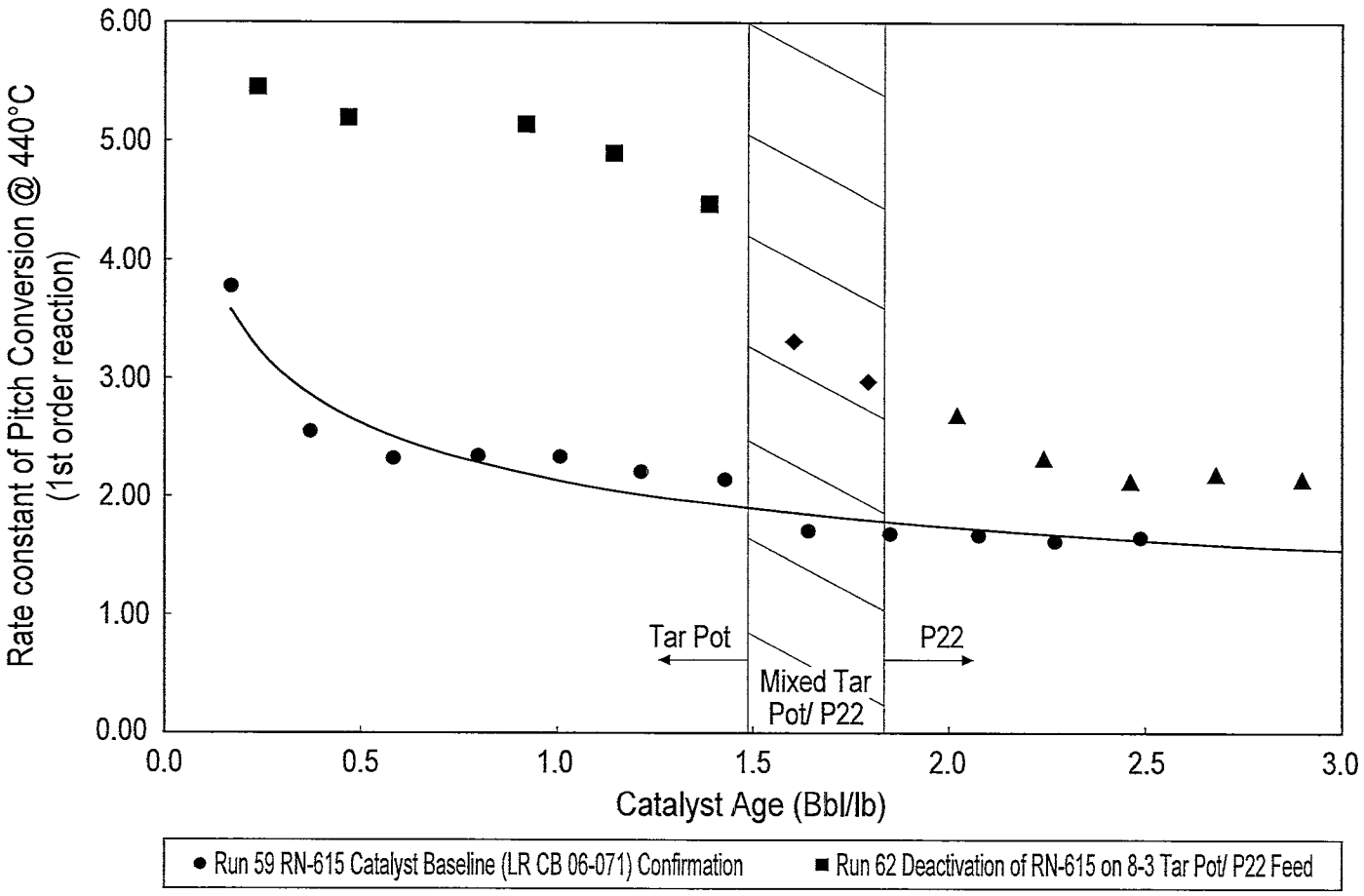
FIG. 4 shows a graph of the rate constant for pitch conversion showing greater crackability of tar pot material over conventional feed.

Because of the different properties and operating conditions used in the tar pot and standard feed testing, the activities are best compared by the kinetic rate constants. FIG. 4 presents a comparison of the $1^{st}$ order kinetic rate constants of pitch conversion for the tar pot and standard feed. In the case of pitch conversion, the kinetic rate constant is described by the equation:

$$k = \frac{\dot{m}_p}{\rho_p V_{rex}}\left(\frac{X}{1-X}\right) \tag{1}$$

As can be seen, the rate constant for the tar pot feed was superior compared to the standard feed. With the exception of the first mass balance, the kinetic rate constant for pitch conversion of the tar pot feed was over double that of the standard feed. After switching to the standard feed used in run MEBR 59, the pitch conversion kinetics trend closer to the baseline but always maintained an advantage over the baseline run. This may be caused by lower deactivation of the catalyst resulting from lower metals lay-down while running tar pot feed (owing to the low metals content in the feed).

Figure 5:
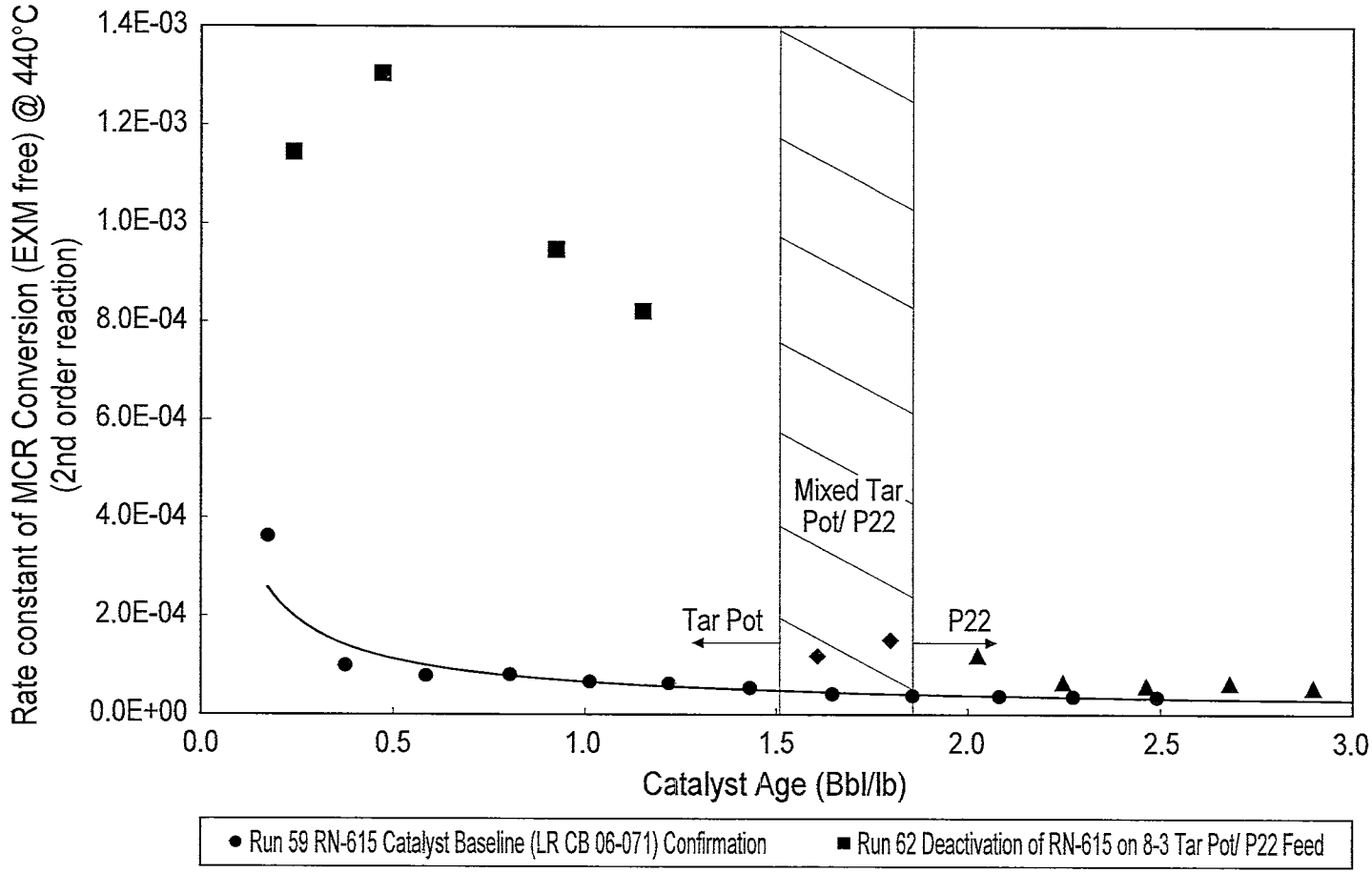
FIG. 5 is a graph showing the rate constant for MCR conversion demonstrating superior conversion of MCR with tar pot material over conventional feed.

FIG. 5 presents a comparison of the $2^{nd}$ order kinetic rate constant of MCR conversion for the tar pot and standard feeds. For the $2^{nd}$ order MCR conversion and any other $2^{nd}$ order catalytically activated reactions, the kinetic rate constant is described by the equation:

$$k = \frac{\dot{m}_p^2}{w_{cat}\dot{m}_f\rho_p^2 x_f}\left(\frac{X}{(1-X)^2}\right) \tag{2}$$

As can be seen, the kinetic rate constant for the tar pot feed was significantly higher than for the standard feed. With the exception of the first mass balance, the kinetic rate constants observed experimentally were in excess of an order of magnitude larger than standard feed. Although this results in a significant conversion advantage for the tar pot feed, it is important to remember that the tar pot feed contains a significantly lower MCR content than does standard MEBR 59 feed. As such, the total pounds of MCR converted in this testing was lower for tar pot than for standard feed. After switching back to standard feed, the kinetics of MCR conversion shows a similar behavior as does the aforementioned pitch conversion: the kinetics trend closer to the baseline test but the standard feed still showed higher activity. The same rationale as that for the pitch conversion is offered for this observed behavior.

Figure 6:
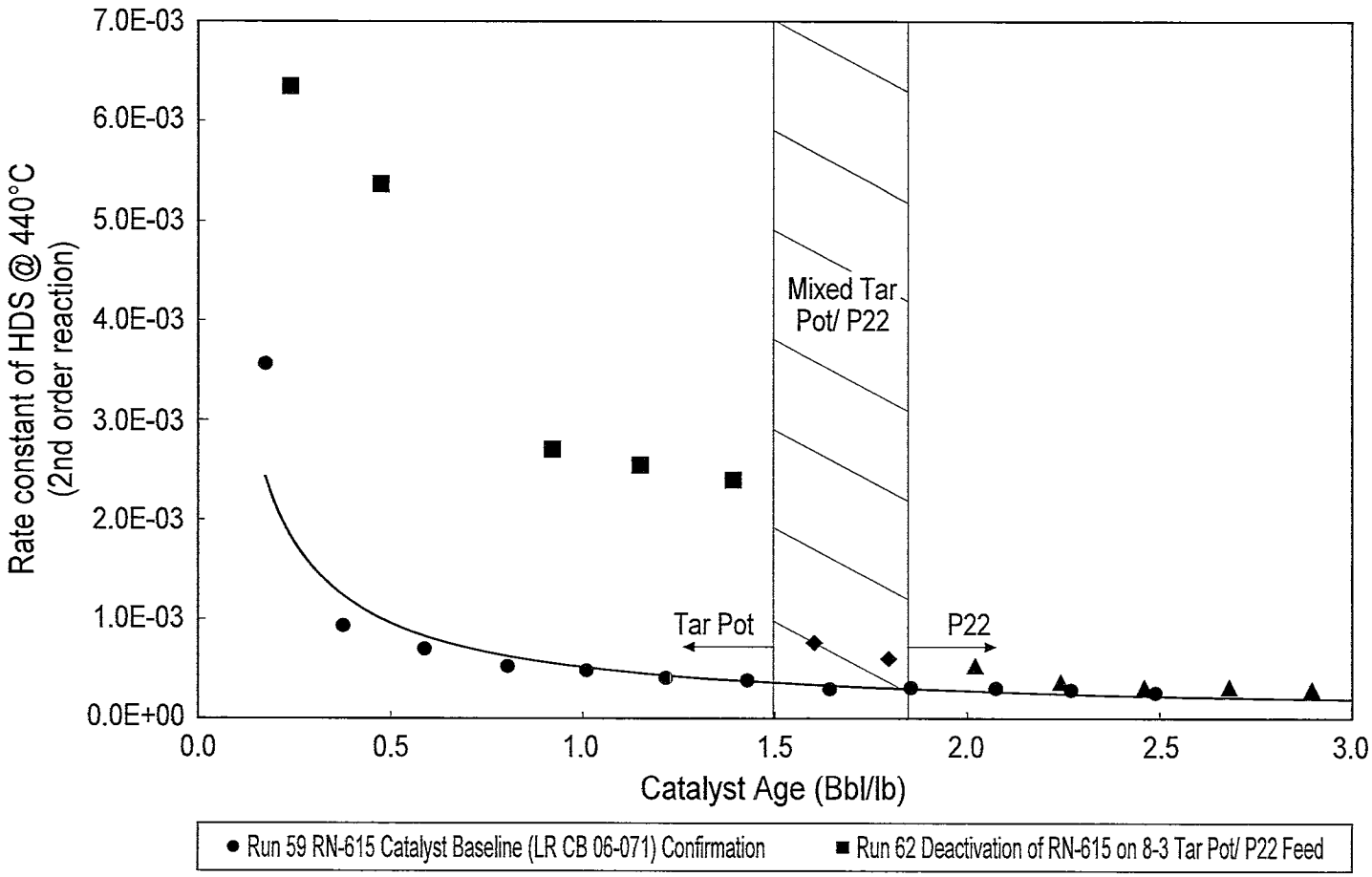
FIG. 6 is a graph showing the rate constant for sulphur removal demonstrating superior sulphur removal with tar pot material over conventional feed.
Figure 7:
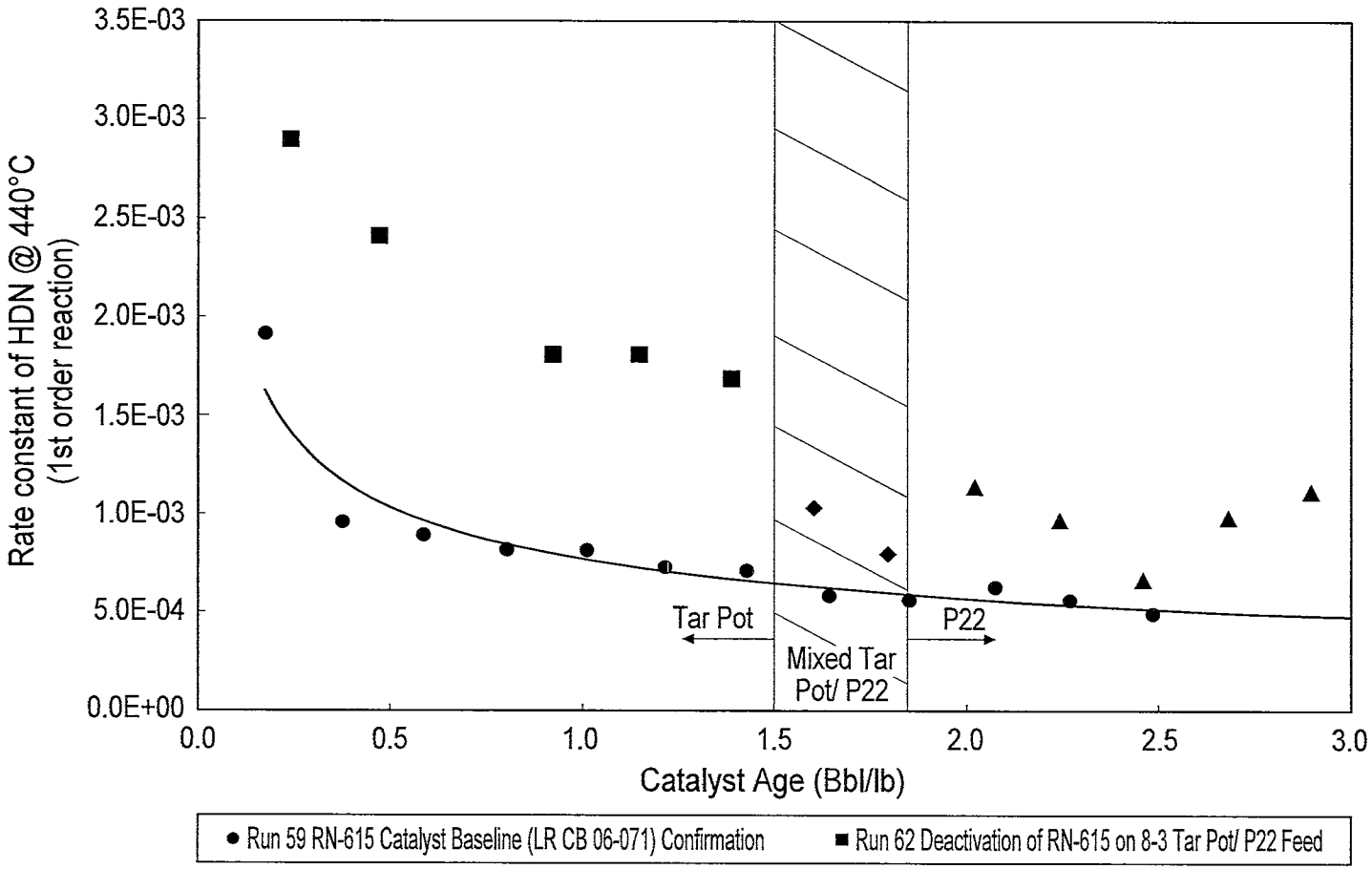
FIG. 7 is a graph showing the rate constant for nitrogen removal demonstrating superior nitrogen removal with tar pot material over conventional feed.
Figure 8:
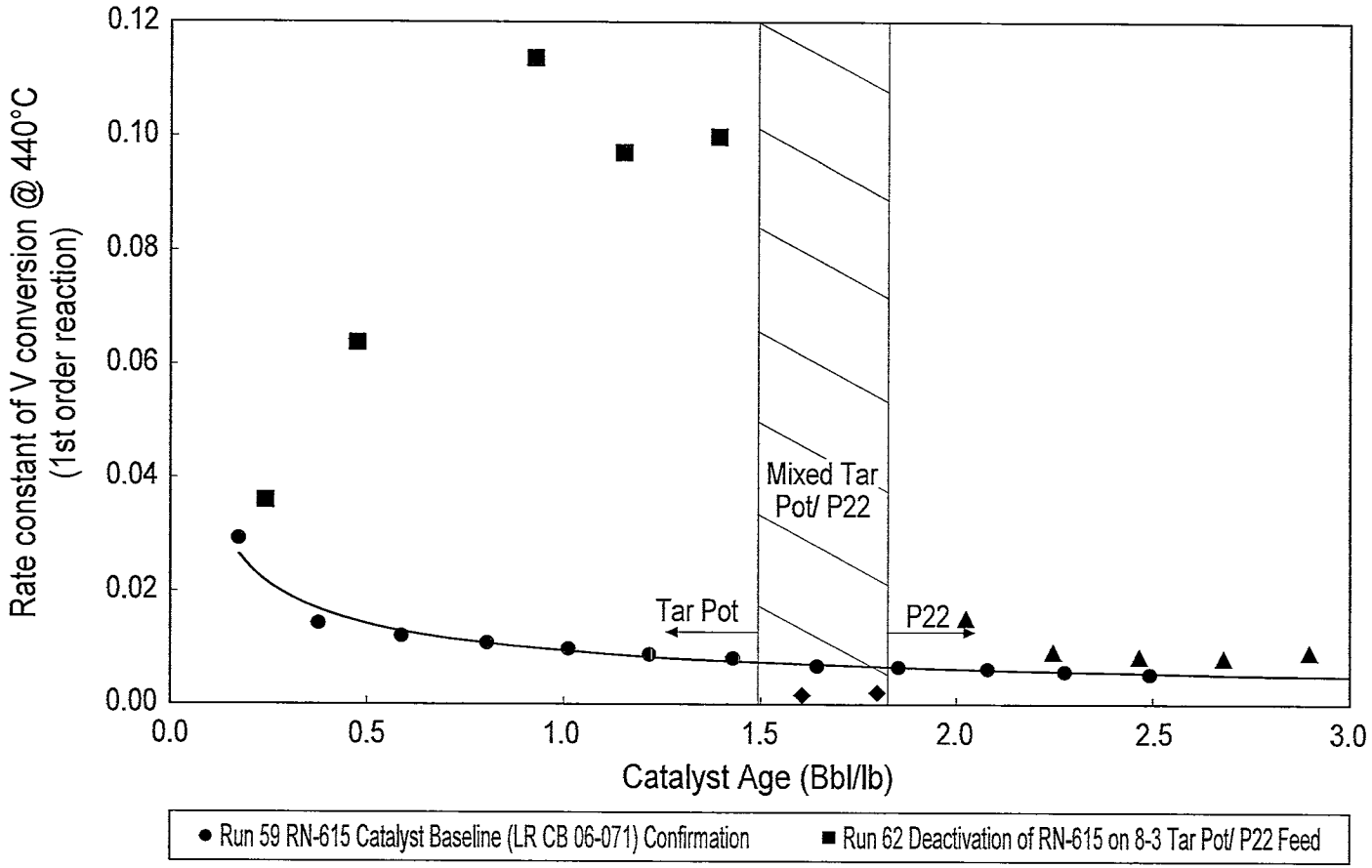
FIG. 8 is a graph showing the rate constant for vanadium removal demonstrating superior vanadium removal with tar pot material over conventional feed.

FIGS. 6, 7 and 8 present comparisons of the kinetic rate constants of sulfur, nitrogen, and vanadium conversion, respectively, between the tar pot feed and standard feed. Compilation of the nickel conversion data is not included since the concentration of nickel in tar pot material is below the detection limit of in-house analytical instrumentation). In the case of sulfur conversion (FIG. 6), the kinetics were described by the $2^{nd}$ order rate equation defined in Equation 2. For nitrogen and vanadium conversion, the kinetics were described by the $1^{st}$ order rate equation:

$$k = \frac{\dot{m}_p}{\rho_p w_{cat}}\left(\frac{X}{1-X}\right) \tag{3}$$

As can be seen in the figures, the kinetics of hydrodesulfurization (HDS), hydrodenitrification (HDN), and hydrodemetalization (HDM) for tar pot material all showed significant advantage over the standard feed baseline run. After converting to tar pot bottoms feed (in MEBR 62) the kinetic rate constants trended closer to the baseline standard feed run (MEBR 59). In the case of sulfur, there did not appear to be a significant difference between the kinetic rate constants for the tar pot bottoms feed in MEBR 62 compared to the baseline values (MEBR 59) at corresponding catalyst ages. In the case of vanadium, the MEBR 62 LC-Finer feed kinetics appeared to be higher than the baseline values.

Table 2 compares the product compositions for standard Plant 22 feed and tar pot feed at a catalyst age of 1.2 bbl/lb. As can be seen in the table, several important observations can be made on the differences between the standard and tar pot product. Among the observations are that tar pot feed appears to be more selective towards the production of HGO than does standard feed. Even though there was deeper conversion of pitch in the tar pot experiment, there is no corresponding increase in the naphtha and LGO production. Another important observation is that the Plant 22 feed appears to be more selective towards the production of hydrocarbon gases than does tar pot feed. On a mass hydrocarbon (HC): mass feed basis, the Plant 22 feed produces 16% more gas than does tar pot feed. Subduing gas production is desirable since gases do not contribute to blending of the final product synthetic crude.

TABLE 2

Comparison between the physical properties of the product oil obtained from baseline Plant 22 (MEBR 59) and tar pot (MEBR 62) feed testing at a catalyst age of 1.2 bbl/lb.

| | Standard ATB/VTB | Tar Pot |
|---|---|---|
| Density (g/mL) | 0.93 | 0.92 |
| Sulfur (wppm) | 17900 | 7900 |
| Nitrogen (wppm) | 4900 | 4000 |
| H/C (mol H/mol C) | 1.57 | 1.54 |
| MCR net of ash (wt %) | 7.8 | 2.0 |
| EXM (wt %) | 1.91 | 0.10 |
| Naphtha in product oil (wt %) | 13 | 11 |
| LGO in product oil (wt %) | 32 | 31 |
| HGO in product oil (wt %) | 31 | 43 |
| Pitch in product oil (wt %) | 23 | 13 |
| Nickel + Vanadium (wppm) | 121 | 1 |
| HC gases/Feedrate (g gas/g feed) | 0.057 | 0.049 |

Figure 9:
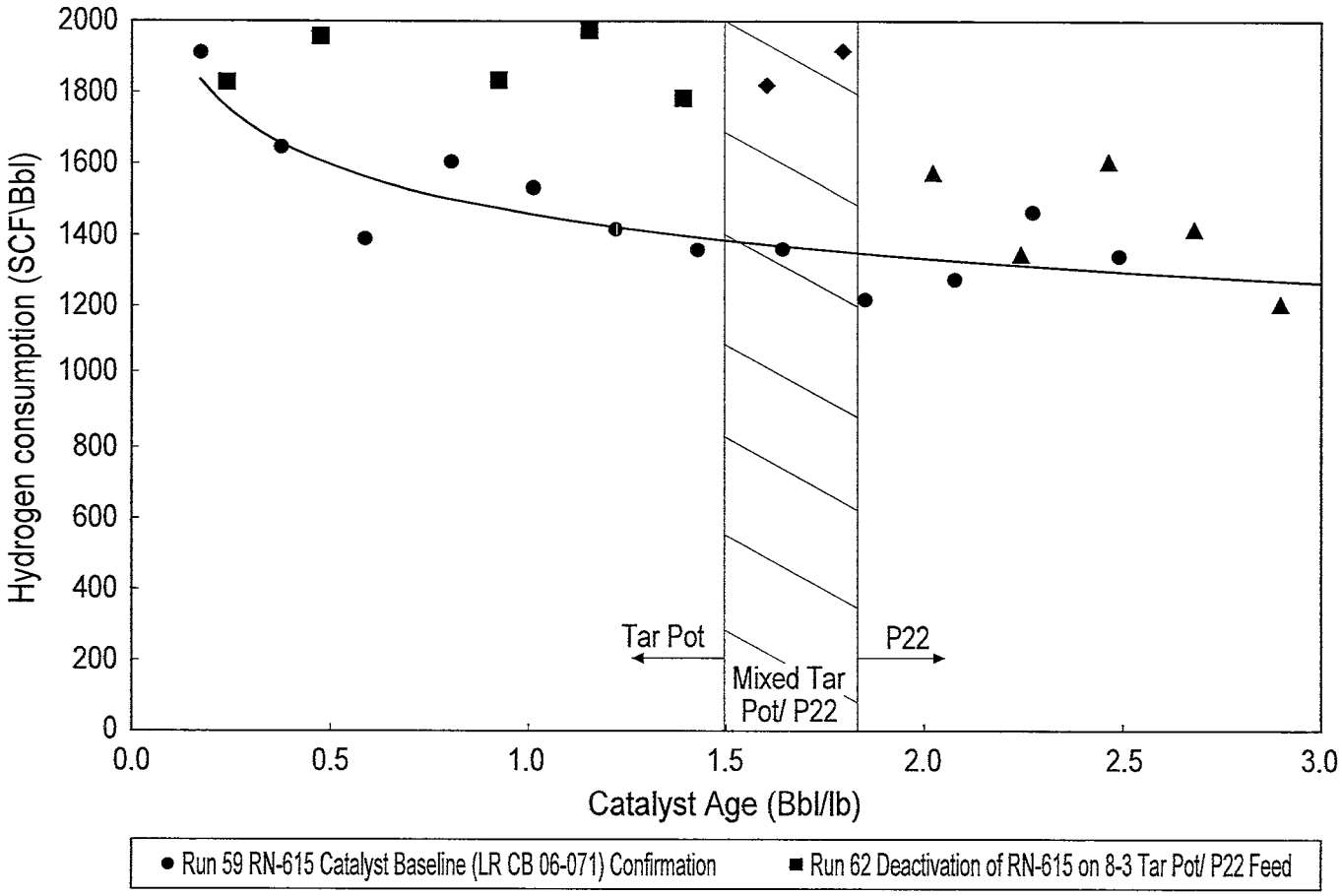
FIG. 9 is a graph showing improved hydrogen consumption when processing tar pot material over conventional feed.
Figure 10:
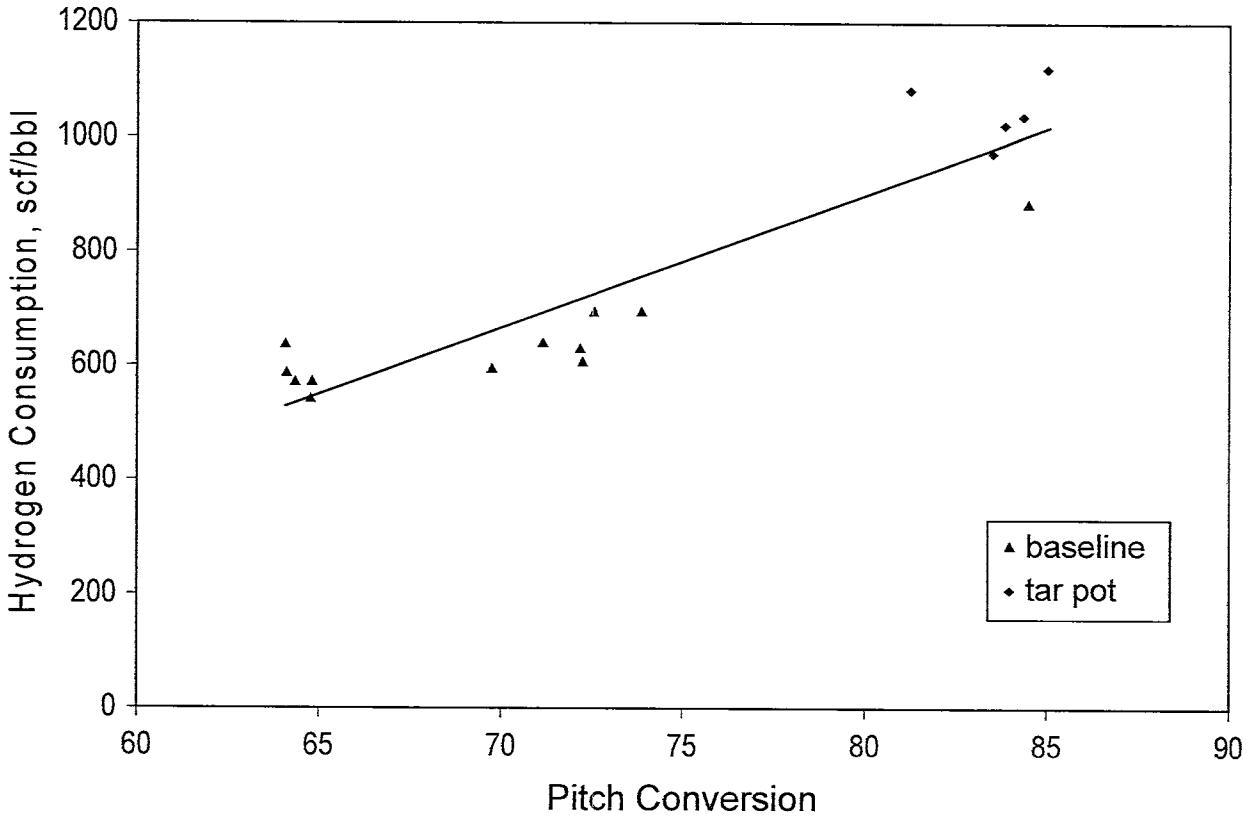
FIG. 10 is a graph showing directional correlation of hydrogen consumption with pitch conversion as a measure of reaction severity.

FIG. 9 presents a comparison of the hydrogen consumption between the tar pot and baseline runs. As can be seen in the figure, the hydrogen consumption for the tar pot feed appears to be sustained at approximately 1900 scf/bbl for the duration of the run (up to a catalyst age of approximately 1.4 lb/bbl). In comparison, the standard feed run shows a deactivation in the hydrogen consumption from approximately 1900 scf/bbl at the start of run (SOR) to approximately 1400 scf/bbl at a catalyst age of 1.4 bbl/lb (predicted value from the power-law trend). The sustained hydrogen consumption in the tar pot experiment suggests a lower rate of catalyst deactivation using the tar pot feed compared to the standard LC-Finer feed. Evaluation of the tar pot kinetics indicated that the tar pot material was more easily converted than LC-Finer feed, and thus it would be expected that the hydrogen consumption would be significantly higher for tar pot feed compared to LC-Finer feed. In general this was the case, with the exception of the first material balance period. For this first material balance period, the conversion for all species in the tar pot material was closely correlated with the standard MEBR 59 feed. However, it is important to remember that the tar pot feed was run at a higher feed rate compared to standard MEBR 59 feed (target: 136 g/hr for tar pot compared to 130 g/hr for the standard MEBR 59 feed; actual feed rates for the first mass balance period: 138 g/hr for the tar pot compared to 127 g/hr for the standard MEBR 59 feed), and thus more total hydrogen was consumed in the tar pot run for all material balance periods.

DEFINITIONS AND INTERPRETATION

As will be apparent to those skilled in the art, various modifications, adaptations and variations of the foregoing specific disclosure can be made without departing from the scope of the invention claimed herein. The various features and elements of the invention described herein may be combined in a manner different than the specific examples described or claimed herein without departing from the scope of the invention. In other words, any element or feature may be combined with any other element or feature in different embodiments, unless there is an obvious or inherent incompatibility between the two, or it is specifically excluded.

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The term "and/or" means any one of the items, any combination of the items, or all of the items with which this term is associated. The phrase "one or more" is readily understood by one of skilled in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by the skilled artisan, all numbers, including those expressing quantities of reagents or ingredients, properties such as molecular weight, reaction conditions, and so forth, are approximations and are understood as being optionally modified in all instances by the term "about." These values can vary depending upon the desired properties sought to be obtained by those skilled in the art utilizing the teachings of the descriptions herein. It is also understood that such values inherently contain variability necessarily resulting from the standard deviations found in their respective testing measurements.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents or carbon groups) includes each specific value, integer, decimal, or identity within the range. Any listed range can be easily recognized as sufficiently describing and enabling the same range being broken down into at least equal halves, thirds, quarters, fifths, or tenths. As a nonlimiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

What is claimed is:

1. A method of upgrading bitumen in a plant comprising a diluent recovery unit that processes diluted bitumen and outputs atmospheric topped bitumen (ATB), and a vacuum distillation unit which processes ATB and outputs vacuum topped bitumen (VTB), the method comprising the step of:

a. processing a feed comprising ATB, VTB, or both ATB and VTB, in at least one fluid coker unit to isolate a naphtha stream, a light gas oil (LGO) stream, a heavy gas oil (HGO) stream and a tar pot bottom stream comprising heavy heavy gas oil (HHGO);

b. processing the tar pot bottom stream comprising HHGO in a catalytic hydrocracking unit comprising an ebullated bed reactor to produce naphtha, light gas oil, and heavy gas oil.

2. The method as claimed in claim 1, further comprising:

c. recycling any unconverted bottoms from the catalytic hydrocracking unit to the at least one fluid coker unit.

3. The method as claimed in claim 1, further comprising:

c. sending as product any unconverted bottoms from the catalytic hydrocracking unit to a fluid catalytic cracker as fluid catalytic cracking feed.

4. The method as claimed in claim 1, further comprising:

c. using the HGO stream from step a. as a grid wash in the at least one fluid coker unit.

5. The method as claimed in claim 1, further comprising:

c. treating the HGO stream from step a. in at least one heavy gas oil hydrotreater.

6. The method as claimed in claim 1, further comprising:

c. treating the LGO stream from step a. in at least one naphtha hydrotreater.

* * * * *